US009912065B2

(12) United States Patent
Kim et al.

(10) Patent No.: US 9,912,065 B2
(45) Date of Patent: Mar. 6, 2018

(54) DIPOLE ANTENNA MODULE AND ELECTRONIC APPARATUS INCLUDING THE SAME

(71) Applicant: Samsung Electronics Co., Ltd, Suwon-si, Gyeonggi-do (KR)

(72) Inventors: Tae-young Kim, Suwon-si (KR); Chee-hwan Yang, Yongin-si (KR); In-young Lee, Hwaseong-si (KR); Sang-hoon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 143 days.

(21) Appl. No.: 13/928,524

(22) Filed: Jun. 27, 2013

(65) Prior Publication Data

US 2014/0132468 A1 May 15, 2014

Related U.S. Application Data

(60) Provisional application No. 61/726,674, filed on Nov. 15, 2012.

(30) Foreign Application Priority Data

Jan. 8, 2013 (KR) ..... 10-2013-0002155

(51) Int. Cl.
*H01Q 9/28* (2006.01)
*H01Q 9/26* (2006.01)
(Continued)

(52) U.S. Cl.
CPC ..... *H01Q 9/285* (2013.01); *H01Q 5/371* (2015.01); *H01Q 9/26* (2013.01); *H01Q 1/2266* (2013.01); *H01Q 1/48* (2013.01)

(58) Field of Classification Search
CPC ..... H01Q 9/285
(Continued)

(56) References Cited

U.S. PATENT DOCUMENTS 6,369,771 B1 * 4/2002 Chiang ..... H01Q 1/242 343/700 MS
7,034,769 B2 * 4/2006 Surducan ..... H01Q 1/38 343/700 MS
(Continued)

FOREIGN PATENT DOCUMENTS

KR 2011-0064848 6/2011
WO 2012-047085 4/2012
WO 2012-071315 5/2012

OTHER PUBLICATIONS

Search Report and Written Opinion dated Jan. 21, 2014 issued in International Application No. PCT/KR2013/008789.
Extended European Search Report dated Feb. 20, 2014 issued in EP Application No. 13193070.3.
European Office Action dated Oct. 20, 2017 in corresponding European Patent Application No. 13 193 070.3.

*Primary Examiner* — Dameon E Levi
*Assistant Examiner* — Walter Davis
(74) *Attorney, Agent, or Firm* — Staas & Halsey LLP

(57) ABSTRACT

A dipole antenna module and an electronic apparatus include an antenna element, a power feeder formed at an end of the antenna element and connected to a circuit board to process an antenna signal through a cable, and a ground part to ground a ground of the cable such that the ground part keeps a preset gap from the antenna element and is grounded to a conductor of the circuit board.

25 Claims, 12 Drawing Sheets

(51) Int. Cl.
*H01Q 5/371* (2015.01)
*H01Q 1/22* (2006.01)
*H01Q 1/48* (2006.01)

(58) Field of Classification Search
USPC ..... 343/793, 770
See application file for complete search history.

(56) References Cited

U.S. PATENT DOCUMENTS

| | | | | |
|---|---|---|---|---|
| 7,126,555 | B2 | 10/2006 | Huang | |
| 7,321,333 | B2 * | 1/2008 | Tsai | H01Q 1/38 343/700 MS |
| 7,432,859 | B2 * | 10/2008 | Zinanti | H01Q 9/04 343/700 MS |
| 7,724,201 | B2 * | 5/2010 | Nysen | H01Q 1/2275 343/700 MS |
| 7,746,286 | B2 | 6/2010 | Suzuki | |
| 7,777,684 | B2 * | 8/2010 | Rao | H01Q 1/243 343/770 |
| 2004/0196191 | A1 | 10/2004 | Hung et al. | |
| 2004/0233110 | A1 | 11/2004 | Hung et al. | |
| 2007/0024503 | A1 | 2/2007 | Tsai et al. | |
| 2007/0164906 | A1 | 7/2007 | Tsai | |
| 2008/0106481 | A1 | 5/2008 | Lin et al. | |
| 2011/0279344 | A1 * | 11/2011 | He | H01Q 1/2291 343/852 |

* cited by examiner

DIPOLE ANTENNA MODULE AND ELECTRONIC APPARATUS INCLUDING THE SAME

CROSS-REFERENCE TO RELATED APPLICATIONS

This application claims priority under 35 U.S.C. § 120 from U.S. Provisional Patent Application No. 61/726,674, filed on Nov. 15, 2012, in the United States Patent and Trademark Office, and under 35 U.S.C. § 119 from Korean Patent Application No. 10-2013-0002155, filed on Jan. 8, 2013, in the Korean Intellectual Property Office, the disclosure of which is incorporated herein by reference in its entirety.

BACKGROUND OF THE INVENTION

1. Field of the Invention

The present general inventive concept generally relates to providing a dipole antenna module and an electronic apparatus including the same, and more particularly, to providing a dipole antenna module having a cable ground structure and an electronic apparatus including the same.

2. Description of the Related Art

Advancements in communication technologies have resulted in the development of various wirelessly communicable electronic apparatuses. For example, smart phones, personal data assistants (PDAs), laptop computers, and tablet computers include elements entrenched therein to allow for wireless communication between various portable electronic apparatuses.

An antenna refers to an apparatus that emits or receives electromagnetic waves to perform wireless communication. Examples of multi-band antennas useable in various bands include a dipole antenna structure having a multi-band resonator, a Planar Inverted-F Antenna (PIFA) structure, etc.

To improve portability of these wireless communication electronic apparatuses by making them slim and small, space within the electronic apparatuses to install components and antennas to perform the wireless communication is reduced. As a result, noise increases due to interference between various internal components, between a component and an antenna, and between an antenna and another antenna, and thus, wireless performance of the electronic apparatuses is reduced.

Accordingly, a conventional portable electronic apparatus uses a planar type dipole antenna including a chip type balanced circuit to attempt to decrease the noise caused by the interference between various internal components, between a component and an antenna, and between an antenna and another antenna, i.e., a platform noise. However, the chip type balanced circuit is usable only in a single band.

Also, when the planar type dipole antenna including the chip type balanced circuit is installed within the conventional portable electronic apparatus, the chip type balanced circuit is converted into an unbalanced circuit. Therefore, dipole patterns are not uniformly emitted in all directions.

SUMMARY OF THE INVENTION

The present general inventive concept provides a dipole antenna module that improves a wireless performance of a dipole antenna module by using a cable ground structure and an electronic apparatus including the same.

Additional features and utilities of the present general inventive concept will be set forth in part in the description which follows and, in part, will be obvious from the description, or may be learned by practice of the general inventive concept.

The foregoing and/or other features and utilities of the present general inventive concept are achieved by providing a dipole antenna module including an antenna element, a power feeder formed at an end of the antenna element and connected to a circuit board to process an antenna signal through a cable, and a ground part to ground a ground of the cable, wherein the ground part keeps a preset gap from the antenna element and is grounded to a conductor of the circuit board.

The antenna element may include a first dipole pattern to resonate at a signal having a first band, and a second dipole pattern electrically connected to the first dipole pattern to resonate at a signal having a second band different from the first band.

At least one of the first and second dipole patterns may have an asymmetrical structure.

The first band may be a 2 GHz band, and the second band may be a 5 GHz band.

The dipole antenna module may further include a board, such that the antenna element, the power feeder, and the ground part may be disposed on a surface of the board.

The board may have a horizontal length of 32 mm, a vertical length of 8 mm, and a height of 0.3 mm.

The ground part may be grounded to a conductor of the circuit board by using one of an aluminum sheet and a copper sheet.

The ground part may adjust a radiation pattern and a radiation bandwidth of the antenna element by using a capacitance formed between the ground part and the antenna element.

The capacitance may increase with an increase in a length of the antenna element and decrease with an increase in the preset gap.

The ground part may be designed from a point a preset length apart from an open point of the antenna element to exhibit a maximum capacitor effect.

The ground part may be connected to a ground of the cable that is exposed due to partial stripping of a coating of the cable.

The conductor may be a display panel or a metal hinge.

The foregoing and/or other features and utilities of the present general inventive concept may also be achieved by providing an electronic apparatus including a dipole antenna module, and a communication interface connected to the dipole antenna module to communicate with an external apparatus, such that the dipole antenna module may include an antenna element, a power feeder formed at an end of the antenna element and connected to the communication interface through a cable, and a ground part to ground a ground of the cable, such that the ground part may keep a preset gap from the antenna element and is grounded to a conductor of the electronic apparatus.

The antenna element may include a first dipole pattern to resonate at a signal having a first band, and a second dipole pattern electrically connected to the first dipole pattern to resonate at a signal having a second band different from the first band.

At least one of the first and second dipole patterns may have an asymmetrical structure.

The first band may be a 2 GHz band, and the second band may be a 5 GHz band.

The electronic apparatus may further include a board such that the antenna element, the power feeder, and the ground part may be disposed on a surface of the board.

The board may have a horizontal length of 32 mm, a vertical length of 8 mm, and a height of 0.3 mm.

The ground part may be grounded to a conductor of the circuit board by using one of an aluminum sheet and a copper sheet.

The ground part may adjust a radiation pattern and a radiation bandwidth of the antenna element by using a capacitance formed between the ground part and the antenna element.

The capacitance may increase with an increase in a length of the antenna element and decrease with an increase in the preset gap.

The ground part may be designed from a point a preset length apart from an open point of the antenna element to exhibit a maximum capacitor effect.

The ground part may be connected to a ground of the cable exposed due to partial stripping of a coating of the cable.

The dipole antenna module may be disposed on a side of one of a display panel and a hinge of the electronic apparatus.

The foregoing and/or other features and utilities of the present general inventive concept may also be achieved by providing a dipole antenna module, including a dipole antenna module, a power feeder formed at an end of the antenna element on a circuit board, and connected to an internal conductor of a cable, and a ground part spaced apart from the antenna element to connect a ground of the cable to a potential of the circuit board The foregoing and/or other features and utilities of the present general inventive concept may also be achieved by providing a dipole antenna module disposed on an electronic apparatus to allow the electronic apparatus to communicate with an external apparatus, the dipole antenna module including an antenna element disposed on a circuit board and divided into a first antenna element half and a second antenna element half such that the first antenna element half and the second antenna element half are asymmetrical to each other, a power feeder connected to the circuit board to transmit and receive antenna signals to and from the antenna element via a cable, and a ground part disposed on the circuit board to be spaced apart from the second antenna element half by a predetermined gap in a vertical direction to ground a ground of the cable.

The second antenna element half may include a dipole pattern including an open point.

The ground part may be disposed a preset distance away from the open point in a horizontal direction.

The preset distance and the predetermined gap may be inversely proportional to each other.

The first antenna element half and the second antenna element half may each include first and second dipole patterns.

The first dipole pattern of the first antenna element half may be assymmetrical to the first dipole pattern of the second antenna element half, and the second dipole pattern of first antenna element half may be symmetrical to the second dipole pattern of the second antenna element half.

The power feeder may receive the antenna signals from the electronic apparatus such that the received antenna signals are transmitted through the antenna element to the external apparatus, and the antenna element may receive the antenna signals from the external apparatus such that the received antenna signals are transmitted through the power feeder to the electronic apparatus.

The foregoing and/or other features and utilities of the present general inventive concept may also be achieved by providing a dipole antenna module, including a first antenna element disposed on a circuit board and including a first dipole pattern and a second dipole pattern, a second antenna element disposed on the circuit board and including a third dipole pattern symmetrical to the first dipole pattern and a fourth dipole pattern assymetrical to the second dipole pattern, a power feeder connected to the circuit board to transmit and receive antenna signals to and from the antenna element via a cable, and a ground part disposed on the circuit board to be spaced apart from the second antenna element by a predetermined gap in a vertical direction and from an open point within the second antenna element in a horizontal direction to ground a ground of the cable.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
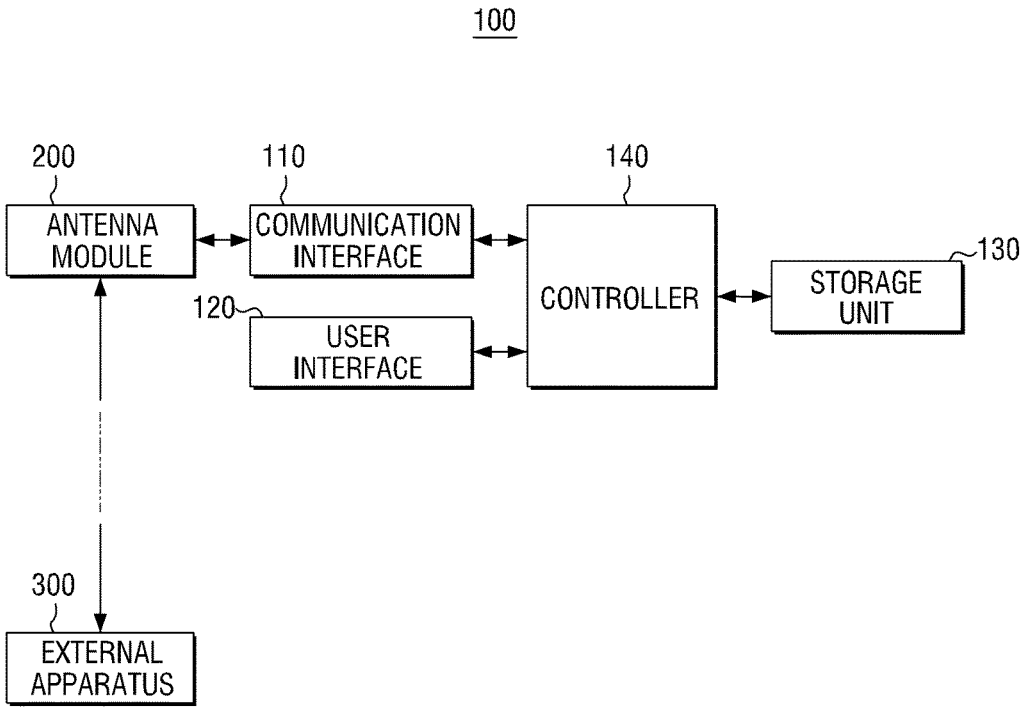
FIG. 1 is a block diagram illustrating a structure of an electronic apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

An electronic apparatus described in the present specification may be realized as a portable electronic apparatus including a notebook computer, a tablet PC, a mobile phone, etc., but is not limited thereto.

FIG. 1 is a block diagram illustrating a structure of an electronic apparatus 100 according to an exemplary embodiment of the present general inventive concept.

Referring to FIG. 1, the electronic apparatus includes a dipole antenna module 200, a communication interface 110, a user interface (UI) 120, a storage unit 130, and a controller 140.

The communication interface 110 is connected to the dipole antenna module 200 to communicate with an external apparatus 300. In detail, the communication interface 110 may include a circuit board including a modulator, a radio frequency (RF) converter, an equalizer, etc., but is not limited thereto.

Figure 2:
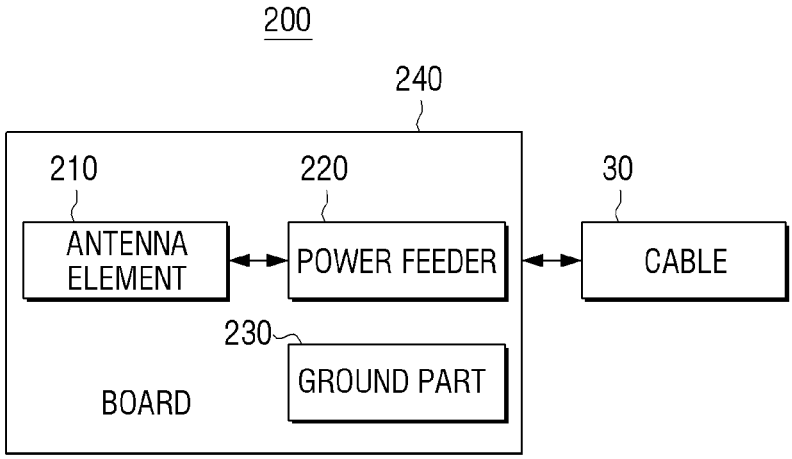
FIG. 2 is a block diagram illustrating a structure of a dipole antenna module according to an exemplary embodiment of the present general inventive concept.

Referring to FIGS. 1 and 2, the communication interface 110 is electrically connected to a power feeder 220 of the dipole antenna module 200 via a cable 30. The cable 30 operates as a power feeder and may be a coaxial cable including an external conductor and an internal conductor. The external conductor of the cable may be a ground area of the cable.

The dipole antenna module 200 will be described in detail later with reference to FIG. 2.

The UI 120 may include a plurality of functional keys or a keyboard to allow a user to set or select various types of functions supported by the electronic apparatus 100. The UI 120 also displays various types of information provided in the electronic apparatus 100.

The UI 120 may include a device combining a monitor and a computer mouse, roller-ball, or touch-pad, or may include a device that combines a simultaneous input and output, such as a touch screen, etc. Also, the UI 120 may include a touch sensor (not illustrated) and a display (not illustrated). The touch sensor may include a touch sensor that senses a user touch, a proximity sensor that senses a proximity of a user touch, a hear sensor that sense a heat signature of a user, etc., but is not limited thereto. The display may include a liquid crystal display (LCD) panel, a plasma panel, a light emitting diode (LED) panel, etc., but is not limited thereto, which may display various types of screens, such as a wallpaper including various types of icons, a web browsing screen, an application execution screen, a screen to play various types of contents such as moving pictures, photos, etc., a UI screen, etc.

The storage unit 130 may include an internal storage medium of the electronic apparatus 100 or an external storage medium, e.g., a removable disk including a universal serial bus (USB) memory, a web server through a network, etc., but is not limited thereto. The current exemplary embodiment of the present general inventive concept includes a random access memory (RAM) or a read only memory (ROM) as an element of the controller 140, but alternatively may be realized as an element of the storage unit 130.

The term "storage unit" may include the storage unit 130, a ROM, a RAM, or a memory card (e.g., a secure digital (SD) card or a memory stick) that may be installed in and/or removed from the electronic apparatus 100. Also, the storage unit may include a non-volatile memory, a volatile memory, a hard disk drive (HDD), or a solid state drive (SSD).

The controller 140 controls elements of the electronic apparatus 100. In detail, the controller 140 includes a ROM that stores a control program to control a central processing unit (CPU) and the electronic apparatus 100, and a RAM that memorizes a signal or data input from an outside of the electronic apparatus 100, or is used as a memory area corresponding to a job performed in the electronic apparatus 100. The CPU may include at least one of a single core processor, a dual core processor, a triple core processor, and a quad core processor. The CPU, the ROM, and the RAM may be connected to one another through an internal bus.

The electronic apparatus 100 as described above may communicate with the external apparatus 300 by using the dipole antenna module 200. As a result, noise generated between the electronic apparatus 100 and the dipole antenna module 200 is decreased to improve a wireless performance.

FIG. 2 is a block diagram illustrating a structure of the dipole antenna module 200 according to an exemplary embodiment of the present general inventive concept.

Referring to FIG. 2, the dipole antenna module 200 includes a board 240 (i.e., a circuit board), an antenna element 210, the power feeder 220, and a ground part 230. As illustrated in FIG. 2, the antenna element 210, the power feeder 220, and the ground part 230 may be disposed on a surface of the board 240.

The board 240 may be formed to have a hexagonal shape. Furthermore, the board 240 may be formed in a shape having a horizontal length of 32 mm, a vertical length of 8 mm, and a height of 0.3 mm. Although the board 240 is described to be formed in the hexagonal shape in the present exemplary embodiment, the board 240 may be formed in other shapes.

The antenna element 210 is electrically connected to a first dipole pattern and includes a second dipole pattern different from the first dipole pattern. Here, a dipole pattern refers to a dipole type antenna pattern and emits electromagnetic waves from a dipole antenna. For descriptive convenience, the dipole type antenna pattern will be hereinafter referred to as a dipole pattern.

A length of the dipole pattern may be $\lambda/2$ of a band frequency. Here, $\lambda$ represents a wavelength.

A first band may be designed as a 2 GHz band, and a second band may be designed as a 5 GHz band. Also, a length of the dipole pattern may be adjusted to comply with an available band.

At least one of the first and second dipole patterns of the antenna element 210 may be designed in an asymmetrical structure. For example, the second dipole pattern may be designed to be symmetrical based on the power feeder 220, and the first dipole pattern may be designed to be asymmetrical based on the power feeder 220. Alternatively, the first dipole pattern may be designed to symmetrical, and the second dipole pattern may be designed to be asymmetrical. In other words, antenna patterns may be asymmetrically designed to correct an unbalanced current distribution that occurs during power feeding via the cable 30.

The power feeder 220 may be formed at an end of the antenna element 10 to be connected to the communication interface 110, and may include a circuit board to process an antenna signal through the cable 30. In detail, the power feeder 220 includes an incenter (internal conductor) feeding terminal connected to an incenter (internal conductor) of the cable 30 and a ground terminal connected to a ground of the cable 30. The incenter (internal conductor) of the cable 30 may be connected to the incenter (internal conductor) feeding terminal of the power feeder 220, and the ground of the cable 30 may be connected to the ground terminal to transmit the antenna signal processed by the communication interface 110 of the electronic apparatus 100 to the antenna element 210. The antenna signal may be an RF signal.

The cable 30 electrically connects the electronic apparatus 100 to the dipole antenna module 200. In detail, the cable 30 is connected to the power feeder 220 of the dipole antenna module 200 to transmit the antenna signal processed in the electronic apparatus 100 or to transmit an antenna signal received from the dipole antennal module 200 to the electronic apparatus 100.

The cable 30 may sequentially include the internal conductor, an insulator, the ground (i.e., an external conductor), and a coating.

The ground part 230 grounds the ground of the cable 30 to a conductor of the electronic apparatus 100. In detail, the ground part 230 is formed at an end of the board 240 of the dipole antenna module 200 and grounds the ground of the cable 30 connected to the power feeder 200 to the conductor (e.g., a display panel or a metal hinge) of the electronic apparatus 100.

The ground part 230 is grounded to the conductor of the electronic apparatus 200 by using one of an aluminum sheet and a copper sheet. In detail, the ground part 230 is connected to the ground of the cable 30 exposed due to partial stripping of the coating of the cable 30 connected to the internal conductor feeding terminal and the ground terminal of the power feeder 220. Also, the ground part 230 is grounded to the conductor of the electronic apparatus 100 by using the aluminum sheet or the copper sheet.

The ground part 230 is formed at an end of the board and separates from the antenna element 210 to from a predetermined gap therebetween. A capacitor effect occurs in the predetermined gap due to the separation of the ground part 230 from the antenna element 210. The predetermined gap may be set to be within in a range of approximately 1 mm to maximize the capacitor effect.

The ground part 230 adjusts a radiation pattern and a radiation bandwidth of the antenna element 210 by using a capacitance formed by the predetermined gap between the ground part 230 and the antenna element 210. The capacitance may increase as a result of an increase in a length of the antenna element 210 and may decrease as a result of an increase in the predetermined gap.

The dipole antenna module 200 as described above with reference to FIG. 2 includes the ground part 230 to secure a ground area between the ground of the cable 30 and the conductor of the electronic apparatus 100, in order to decrease noise transferred between the electronic apparatus 100 and the dipole antenna module 200.

As a result of the capacitance effect of the predetermined gap between the antenna element 210 and the ground part 230, a balanced circuit and an extension of a bandwidth may occur.

Also, when the balanced circuit is installed within the electronic apparatus 100, the capacitance effect and a cable grounding reinforcement of the present general inventive concept may improve a directivity (e.g., an omnidirectional transmission and receipt of signals) of an antenna.

In addition, since an additional balanced circuit does not need to be applied in the exemplary embodiment of the present general inventive concept, a number of components decreases, a cost price is reduced, and an incidental effect is obtained, i.e., the antennal is further firmly supported by a grounding connection between the electronic apparatus 100 and the ground part 230.

The dipole antenna module 200 will now be described in detail.

Figure 3:
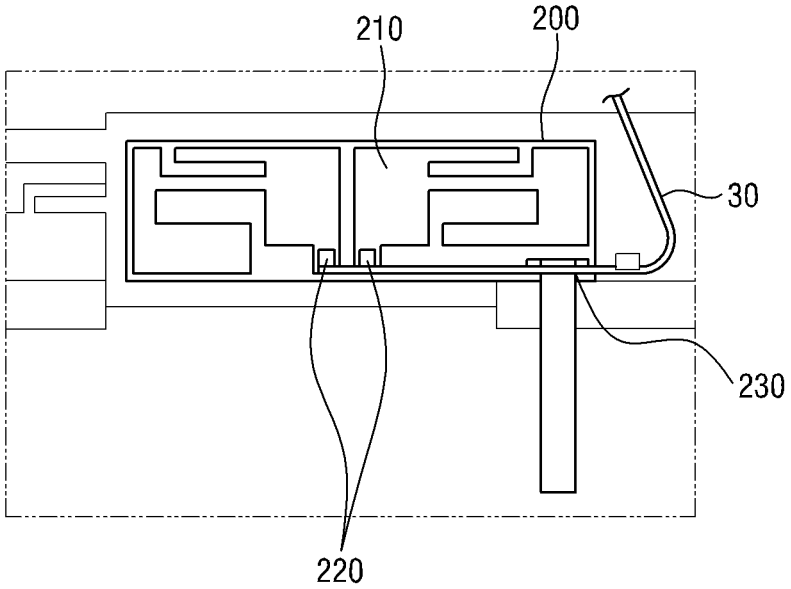
FIG. 3 is a schematic plan view illustrating a dipole antenna module according to an exemplary embodiment of the present general inventive concept.

FIG. 3 is a schematic plan view illustrating the dipole antenna module 200 according to an exemplary embodiment of the present general inventive concept.

Referring to FIG. 3, the dipole antenna module 200 includes the antenna element 210 formed to be asymmetrical, the power feeder 220 formed at an end of the antenna element 210, and the ground part 230 form to form a predetermined gap with the antenna element 210.

The cable 30 of FIG. 2 is connected to an internal conductor feeding terminal and a ground terminal of the power feeder 200, and a ground of the cable 30 is connected to the ground part 230. As illustrated in FIG. 3, the ground part 230 extends as an additional conductor to be grounded to the conductor of the electronic apparatus 100 of FIG. 1.

Figure 4:
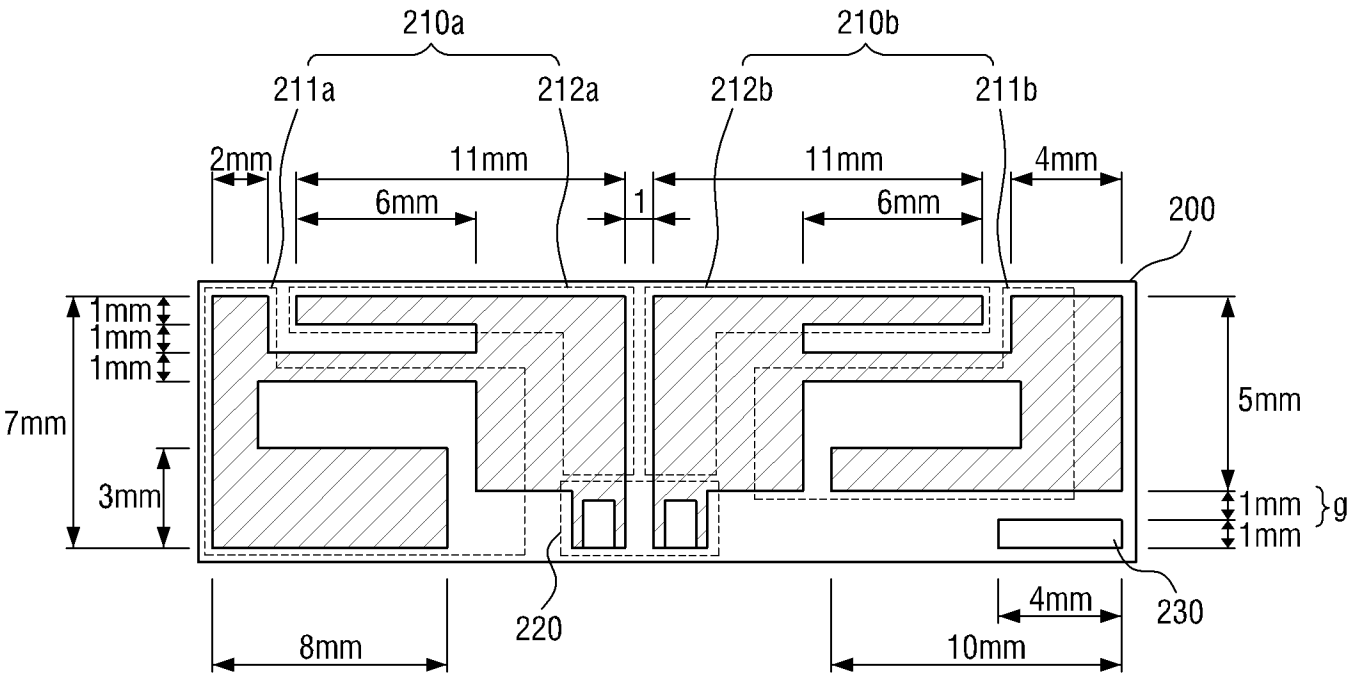
FIG. 4 is a plan view illustrating an arrangement of elements of a dipole antenna module according to an exemplary embodiment of the present general inventive concept.

FIG. 4 is a plan view illustrating arrangements of elements of the dipole antenna module 200 according to an exemplary embodiment of the present general inventive concept.

FIG. 4 illustrates actual scaled sizes and spaces of the elements of the dipole antenna module 200.

The antenna element 210 of FIG. 3 may be divided into a left antenna element 210*a* and a right antenna element 210*b*, as illustrated in FIG. 4, and may include first dipole patterns 211*a* and 211*b* and second dipole patterns 212*a* and 212*b* that are different from the first dipole patterns 211*a* and 211*b*. As illustrated in FIG. 4, lengths of the second dipole patterns 212*a* and 212*b* are shorter than lengths of the first dipole patterns 211*a* and 211*b*, and the second dipole patterns 212 and 212*b* resonate at a signal having a band of 5 GHz. Also, the first dipole patterns 211*a* and 211*b* resonate at a signal having a band of 2 GHz.

As described above, in the present general inventive concept, a dual band resonator having two types of bands is installed. A dual band resonator having bands of 5 GHz and 2 GHz are applied in the above-described exemplary embodiment, but a length of a dipole pattern may be adjusted to adjust to an available band.

Generally, one of first and second dipole patterns of the antenna element 210 of FIG. 3 may be designed to be asymmetrical. In FIG. 4, the left and right antenna elements 210*a* and 210*b*, respectively, illustrate that the first dipole patterns 211*a* and 211*b* are asymmetrical to each other, while the second dipole patterns 212*a* and 212*b* are symmetrical to each other. This asymmetrical design is made to correct an unbalanced current distribution that occurs during power feeding via the cable 30.

The power feeder 220 is formed at the end of the antenna element 210, an internal conductor feeding terminal is disposed at an end of the left antenna element 210*a*, and a ground terminal of the power feeder 220 is disposed at an end of the right antenna element 210*b*.

The ground part 230 is formed at a lower end of the dipole antenna module 200, and is spaced from the antenna element 210 to form a predetermined gap g. The ground part 230 may be rectilinear. As illustrated in FIG. 4, the predetermined gap g between the antenna element 210 and the ground part 230 is 1 mm. A capacitor effect occurs due to the predetermined gap g. The capacitor effect will be described in detail later with reference to FIGS. 7 and 8.

Figure 5:
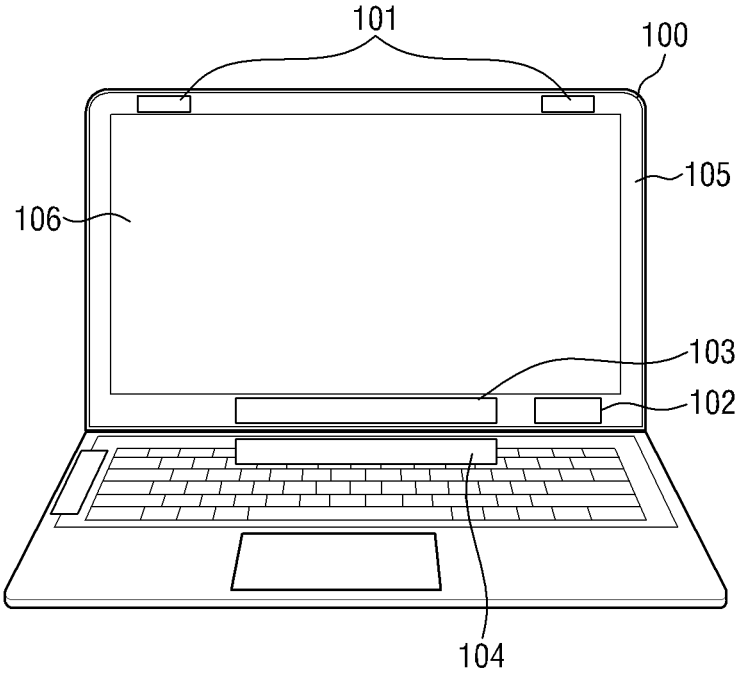
FIGS. 5, 6A, and 6B are views illustrating a position of a dipole antenna module installed in an electronic apparatus according to an exemplary embodiment of the present general inventive concept.
Figure 6A:
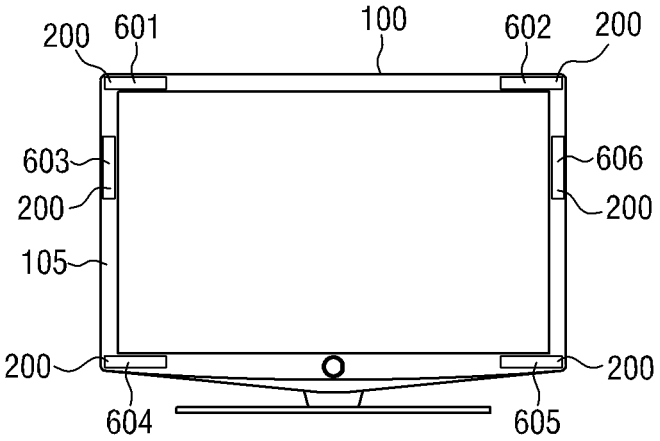
Figure 6B:
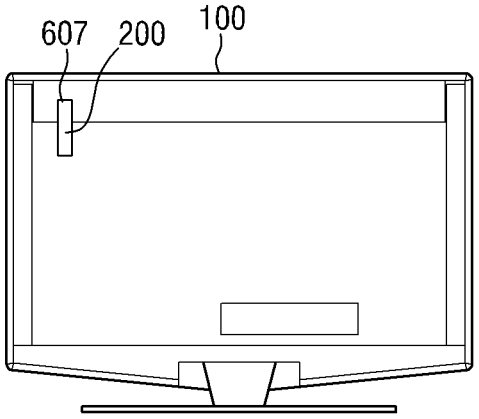

FIGS. 5, 6A, and 6B are views illustrating a position of the dipole antenna module 200 installed in the electronic apparatus 100 according to an exemplary embodiment of the present general inventive concept. The electronic apparatus 100 may be a notebook computer or an all-in-one personal computer (PC).

Referring to FIG. 5, the dipole antenna module 200 may be disposed at an upper end 101 or a lower end 102 of a display panel 105 of the electronic apparatus 100. The dipole antenna module 200 may be disposed on the display panel 105 so as not to contact a screen 106. As such, the display panel 105 may be used as a conductor to be grounded.

Alternatively, the dipole antenna module 200 may be disposed at hinges 103 and 104 of the electronic apparatus 100. As such, the hinges 103 and 104 may be used as conductors to be grounded.

Referring to FIG. 6A, the dipole antenna module 200 may be disposed at front upper ends 601 and 602, front sides 603 and 604, or front lower ends 604 and 606 of the electronic apparatus 100. As such, the display 105 may be used as a conductor to be grounded.

Alternatively, referring to FIG. 6B, the dipole antenna module 200 may be disposed in a predetermined area 607 of a back surface of the electronic apparatus 100.

Figure 7A:
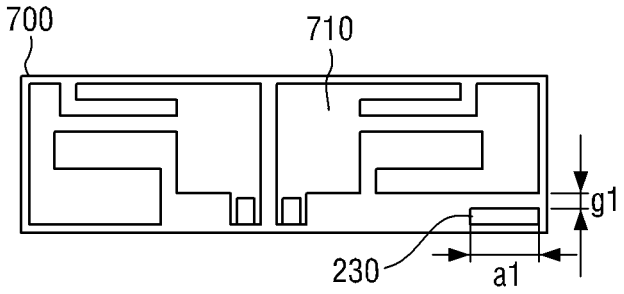
FIGS. 7A and 7B are views illustrating capacitor effects resulting from different sized gaps formed between a ground part and an antenna element of a dipole antenna module according to an exemplary embodiment of the present general inventive concept.
Figure 7B:
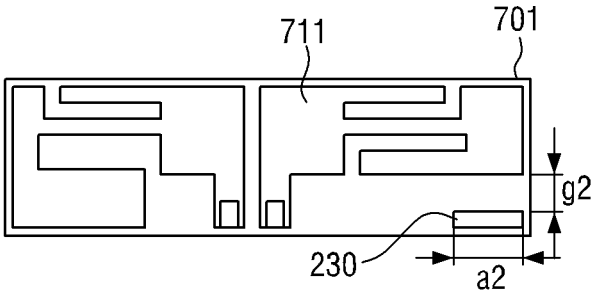

FIGS. 7A and 7B are views illustrating capacitor effects resulting from different sized gaps formed between the ground part 230 and the antenna element 210 of the dipole antenna module 200, according to an exemplary embodiment of the present general inventive concept.

As stated above, a capacitor effect results from a gap that is formed between the ground part 230 and the antenna element 210.

As a result of the capacitor effect, a balanced circuit and an extension of a bandwidth may occur.

When the balanced circuit is installed within the electronic apparatus 100, the capacitor effect and a cable grounding reinforcement of the present general inventive concept may improve a directivity (e.g., an omnidirectional transmission and receipt of signals) of an antenna.

A capacitor component resulting from the gap between the ground part 230 and the antenna element 210 may be calculated as in Equation 1 below:

$$C = \frac{2\varepsilon_0\varepsilon_e a}{\pi}\ln\left(\csc\left(\frac{\pi g}{2a}\right)\right)$$

wherein "C" represents a capacitance, "a" represents a length of the ground part 230, "g" represents the predetermined gap between the ground part 230 and the antenna element 210, "$\in_e$" represents an effective dielectric constant, "$\in_0$" represents a uniform dielectric constant in vacuum, "In" refers to a mathematical operation of a natural logarithm, and "csc" represents the mathematical term of cosecant.

A length of the ground part 230 of a dipole antenna module 700 of FIG. 7A is equal to a length of the ground part 230 of a dipole antenna module 701 of FIG. 7B, i.e., $a_1=a_2$.

However, a gap g1 between the ground part 230 and an antenna element 710 of the dipole antenna module 700 of FIG. 7A is different from a gap g2 between the ground part 230 and an antenna element 711 of the dipole antenna module 701 of FIG. 7B, i.e., $g_1<g_2$. If for the above variables were applied in Equation 1, a capacitance $C_1$ of the dipole antenna module of FIG. 7A would be greater than a capacitance $C_2$ of the dipole antenna module of FIG. 7B. Therefore, a narrow gap between the ground part 230 and the antenna element 210 of FIG. 2 would result in a larger capacitor effect, while a larger gap between the ground part 230 and the antenna element 210 of FIG. 2 would result in a smaller capacitor effect.

Accordingly, the gap g between the ground part 230 and the antenna element 210 and a length a of the ground part 230 may be adjusted to adjust a capacitance C occurring between the antenna element 210 and the ground part 230. In other words, a manufacturer may design a gap g between the ground part 230 and the antenna element 210 and a length a of the ground part 230 to generate a maximum capacitance by using Equation 1 above.

Figure 8:
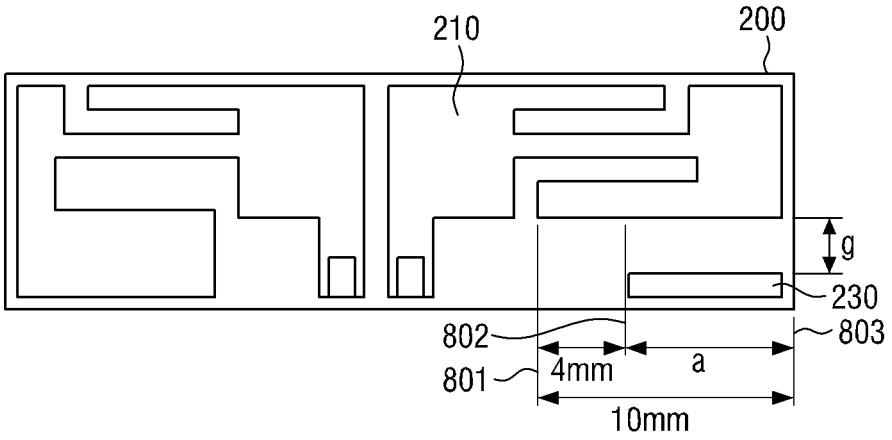
FIG. 8 is a view illustrating a dipole antenna module to exhibit a maximum capacitor effect according to an exemplary embodiment of the present general inventive concept.
Figure 9:
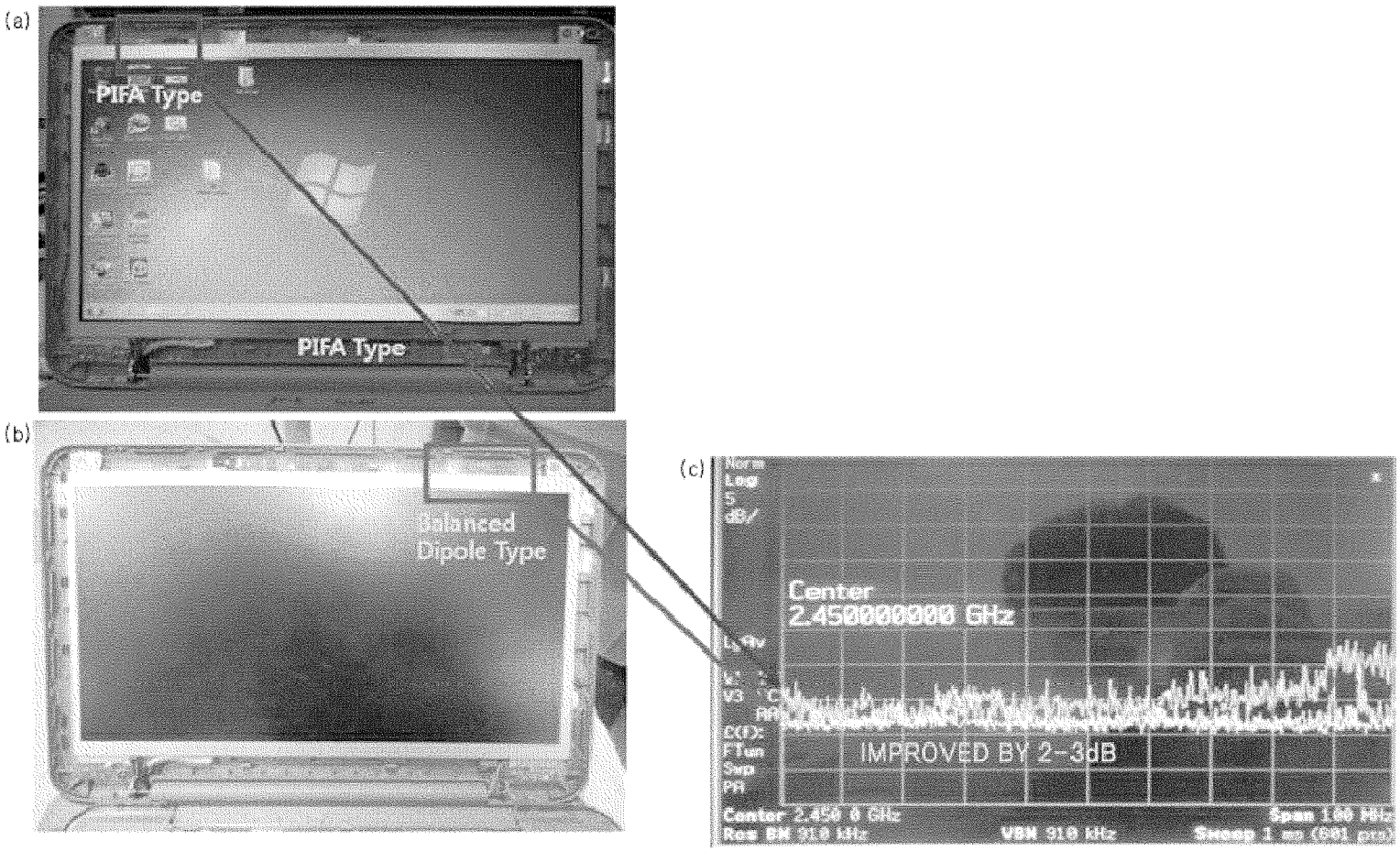
FIGS. 9A through 9C are views illustrating a comparison between noise of a dipole antenna module of the present general inventive concept and noise of a Planar Inverted-F Antenna (PIFA) type dipole antenna module.
Figure 10:
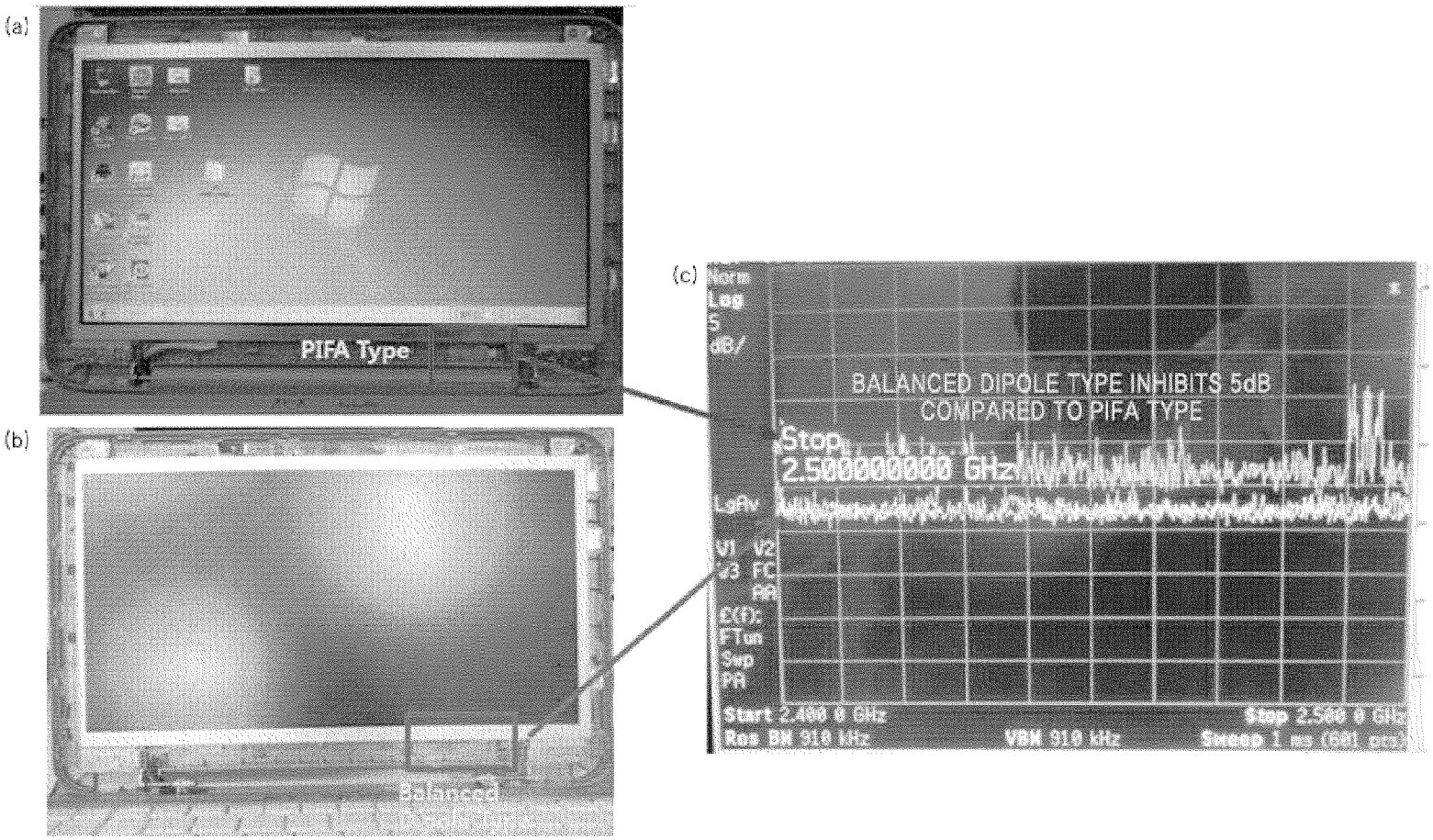
FIGS. 10A through 10C are views illustrating a comparison between noise of the dipole antenna module of the present general inventive concept and noise of the PIFA type dipole antenna module.

FIG. 8 is a view illustrating a dipole antenna module to exhibit a maximum capacitor effect according to an exemplary embodiment of the present general inventive concept.

Hereinafter, the dipole antenna module 200 having a horizontal length of 32 mm and a vertical length of 8 mm will be described.

Referring to FIGS. 2 and 8, the ground part 230 is designed to have a length a that spans from an edge point 803 to a point 802, thereby keeping a preset length in a horizontal direction from an open point 801 of the antenna element 210, in order to exhibit the maximum capacitor effect.

More specifically, as illustrated in FIG. 8, in order to exhibit the maximum capacitor effect, the ground part 230 may be designed so as not to extend past the point 802, such that it is at a distance 4 mm away from the open point 801 of the antenna element 210 in the horizontal direction. In other words, the preset length in the horizontal direction may be 4 mm.

Although the preset length in the horizontal direction is illustrated as 4 mm in FIG. 8, a length of the antenna element 210 may be changed according to various patterns of the antenna element 210, as well as a size of the board 240. As such, the preset length may also change.

If the ground part 230 is designed to be positioned at the same point as the open point 801 of the antenna element 210, a pattern of radiation may not be uniformly distributed in all directions, but may instead be distorted.

According to an exemplary embodiment, in order to exhibit an optimum capacitor effect, the ground part 230 may be designed from the point 802 to be 4 mm apart from the open point 801 of the antenna element 210.

The length a of the ground part 230 may be in inverse proportion to the gap g, which is a gap between the ground part 230 and the antenna element in a vertical direction, in order to exhibit the optimum capacitor effect.

For example, if the length a is 4 mm, and the gap g is 1 mm, the optimum capacitor effect may be exhibited. If the length a is 6 mm, and the gap g is 1.5 mm, the optimum capacitor effect may be exhibited. These optimum capacitor effects may be calculated with reference to Equation 1 above.

An effect of the dipole antenna module 200 of the present general inventive concept will now be described in detail with reference to FIGS. 9A through 12.

FIGS. 9A through 9C and 10A through 100 are views illustrating a comparison between noise of a dipole antenna module 200 of the present general inventive concept and noise of a PIFA type dipole antenna module.

A PIFA type antenna refers to a planar antenna in which a square patch plate having a smaller area is put on a planar ground surface to resemble a letter "F". The PIFA type antenna may be made small to be installed in a portable electronic apparatus such as a cellular telephone.

FIG. 9A illustrates an electronic apparatus in which a PIFA type antenna module is disposed at an upper end of a display panel. FIG. 9B illustrates an electronic apparatus in which the dipole antenna module 200 of the present general inventive concept is disposed at an upper end of a display panel. As a result of measuring noise of the dipole antennal module 200 and noise of the PIFA type antenna module, as illustrated in FIG. 9C, noise transferred to the dipole antenna module 200 is generated about 3 dB less than noise transferred to the PIFA type antenna module.

FIG. 10A illustrates the electronic apparatus in which in which the PIFA type antenna module is disposed at a lower end of the display panel. FIG. 10B illustrates the electronic apparatus the dipole antenna module 200 is disposed at a lower end of the display panel. As a result of measuring noise of the dipole antenna module 200 and noise of the PIFA type antenna module, as illustrated in FIG. 100, noise transferred to the dipole antenna module 200 is generated about 5 dB less than noise transferred to the PIFA type antenna module According to the results of measuring noise as described with reference to FIGS. 9A through 9C and 10A through 10C, the dipole antenna module 200 of the present general inventive concept decreases noise more than the PIFA type antenna module.

Figure 11B:
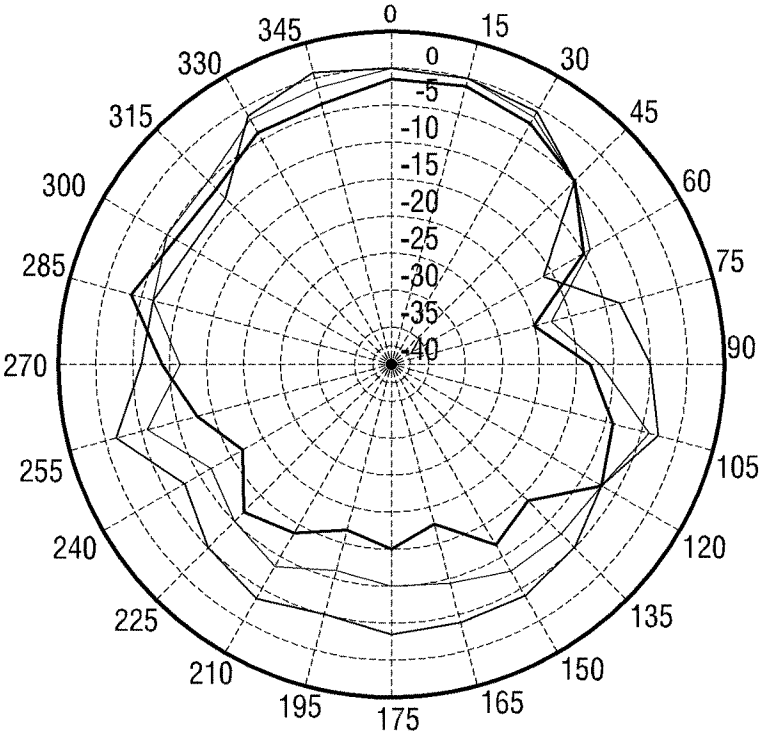
FIGS. 11A and 11B are views illustrating a comparison between a dipole pattern of the dipole antenna module of the present general inventive concept and a dipole pattern of the PIFA type dipole antenna module.
Figure 11A:
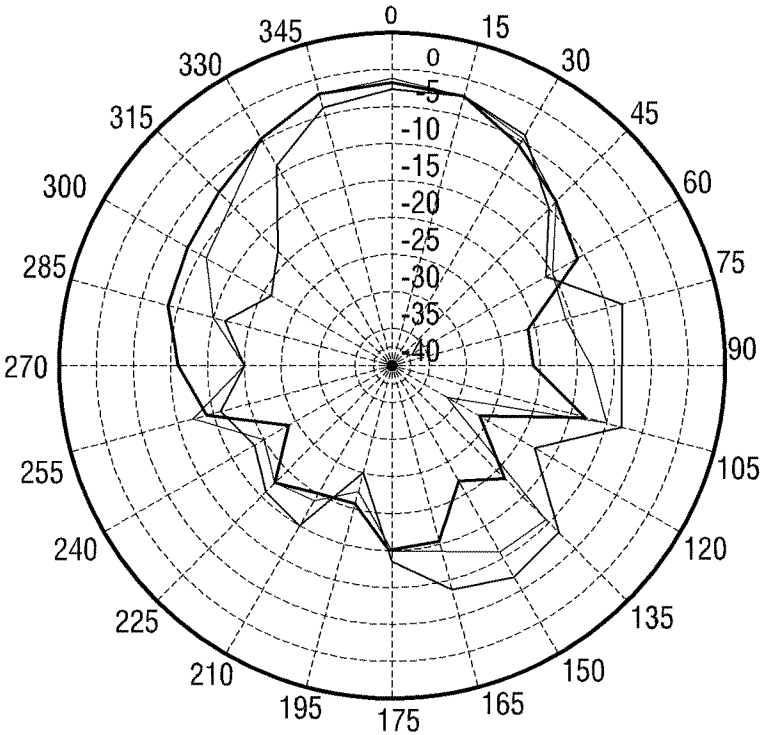

FIGS. 11A and 11B are views illustrating a comparison between a dipole pattern of a dipole antenna module of the present general inventive concept and a dipole pattern of a PIFA type antenna module.

FIG. 11A is a radial view illustrating the dipole pattern of the PIFA type antenna module.

FIG. 11B is a radial view illustrating the dipole pattern of the dipole antenna module 200 of the present general inventive concept.

In comparison between the dipole pattern of the PIFA type antenna module of FIG. 11A and the dipole pattern of the dipole antenna module of FIG. 11B, the dipole pattern of the dipole antenna module 200 of the present general inventive concept is uniformly distributed in all directions.

Referring to FIGS. 11A and 11B, when the dipole antenna module 200 of the present general inventive concept is installed within the electronic apparatus 100, the dipole antenna module 200 experiences a balanced circuit via a grounding reinforcement of a cable ground and a capacitor effect obtained by the ground part 230 to improve a directivity (e.g., an omnidirectional transmission and receipt of signals) of an antenna.

Figure 12:
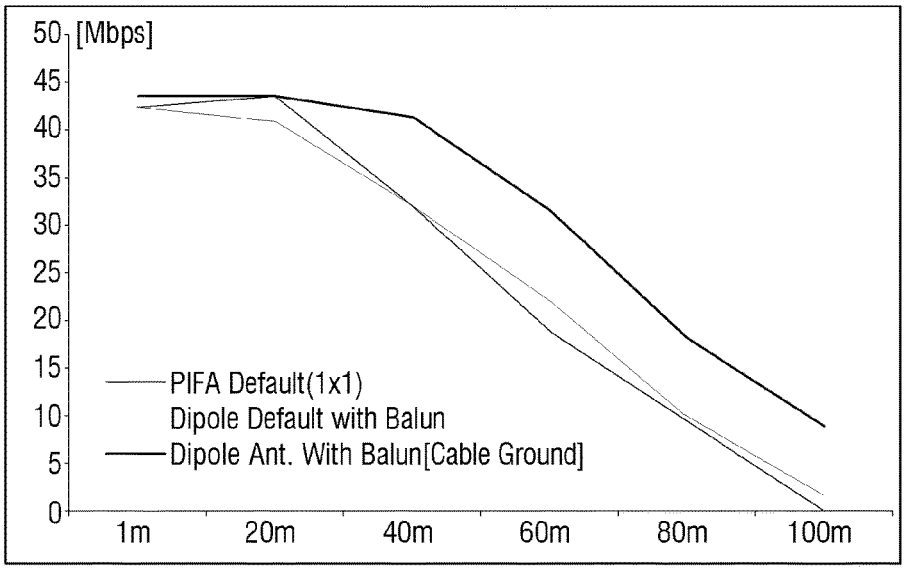
FIG. 12 is a graph illustrating a comparison between a throughput test result of the dipole antenna module of the present general inventive concept, a throughput test result of a conventional dipole antenna module, and a throughput test result of the PIFA type dipole antenna module.

FIG. 12 is a graph illustrating a throughput test result of a dipole antenna module of the present general inventive concept, a throughput test result of a conventional dipole antenna module.

A vertical axis of the graph of FIG. 12 denotes a transmission speed (Mbps), and a horizontal axis of the graph denotes a distance (m).

Referring to FIG. 12, as results of comparing wireless throughput performances of a PIFA antenna, a conventional balanced dipole antenna having a Balun structure (i.e., a structure that converts between a balanced signal (two signals working against each other where ground is irrelevant) and an unbalanced signal (a single signal working against ground or pseudo-ground), and a dipole antenna of the present general inventive concept having a cable ground structure, the wireless throughput performance of the dipole antenna of the present general inventive concept is higher than the wireless throughput performance of the existing balanced dipole antenna.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A dipole antenna module comprising:

an antenna element having an open point where a dipole pattern is not formed;

a power feeder formed at an end of the antenna element and connected to a circuit board to process an antenna signal through a cable; and a rectilinear ground part to ground a ground of the cable to a conductor of the circuit board, the rectilinear ground part being configured to be capacitively coupled with the antenna element in an arrangement to cause a capacitance occurring between the antenna element and the rectilinear ground part, wherein, according to the arrangement, the rectilinear ground part and the antenna element are separated by a gap and formed on a same side of the circuit board, the gap is less than or equal to 1 mm, and the rectilinear ground part is formed on an adjacent region of the open point at a distance from the open point of the antenna element, wherein the capacitance is adjusted due to a size of the gap and the distance of the rectilinear ground part from the open point of the antenna element.

2. The dipole antenna module of claim 1, wherein the antenna element comprises:

a first dipole pattern to resonate at a signal having a first band; and a second dipole pattern electrically connected to the first dipole pattern to resonate at a signal having a second band different from the first band.

3. The dipole antenna module of claim 2, wherein at least one of the first dipole pattern and the second dipole pattern has an asymmetrical structure.

4. The dipole antenna module of claim 2, wherein the first band is a 2 GHz band, and the second band is a 5 GHz band.

5. The dipole antenna module of claim 1, wherein the antenna element, the power feeder, and the rectilinear ground part are disposed on a surface of the circuit board.

6. The dipole antenna module of claim 5, wherein the circuit board has a horizontal length of 32 mm, a vertical length of 8 mm, and a height of 0.3 mm.

7. The dipole antenna module of claim 1, wherein the rectilinear ground part is grounded to the conductor of the circuit board by using one of an aluminum sheet and a copper sheet.

8. The dipole antenna module of claim 1, wherein the rectilinear ground part adjusts a radiation pattern and a radiation bandwidth of the antenna element by using the capacitance occurring between the antenna element and the rectilinear ground part.

9. The dipole antenna module of claim 8, wherein the capacitance increases with an increase in a length of the antenna element and decreases with an increase in the gap.

10. The dipole antenna module of claim 1, wherein the distance is 4 mm to thereby exhibit a maximum capacitor effect.

11. The dipole antenna module of claim 1, wherein the rectilinear ground part is connected to the ground of the cable that is exposed due to partial stripping of a coating of the cable to ground the cable.

12. The dipole antenna module of claim 1, wherein the conductor is a display panel or a metal hinge.

13. An electronic apparatus comprising:

a dipole antenna module; and a communication interface connected to the dipole antenna module to communicate with an external apparatus, wherein the dipole antenna module comprises:

an antenna element having an open point which a dipole pattern is not formed;

a power feeder formed at an end of the antenna element and connected to the communication interface through a cable; and a rectilinear ground part to ground a ground of the cable to a conductor of a circuit board, the rectilinear ground part being configured to be capacitively coupled with the antenna element in an arrangement to cause a capacitance occurring between the antenna element and the rectilinear ground part, wherein, according to the arrangement, the rectilinear ground part and the antenna element are separated by a gap and formed on a same side of the circuit board, the gap is less than or equal to 1 mm, and the rectilinear ground part is formed on an adjacent region of the open point at a distance from the open point of the antenna element, wherein the capacitance is adjusted due to a size of the gap and the distance of the rectilinear ground part from the open point of the antenna element.

14. The electronic apparatus of claim 13, wherein the antenna element comprises:

a first dipole pattern to resonate at a signal having a first band; and a second dipole pattern electrically connected to the first dipole pattern to resonate at a signal having a second band different from the first band.

15. The electronic apparatus of claim 14, wherein at least one of the first dipole pattern and the second dipole pattern has an asymmetrical structure.

16. The electronic apparatus of claim 14, wherein the first band is a 2 GHz band, and the second band is a 5 GHz band.

17. The electronic apparatus of claim 13, wherein the antenna element, the power feeder, and the rectilinear ground part are disposed on a surface of the circuit board.

18. The electronic apparatus of claim 17, wherein the circuit board has a horizontal length of 32 mm, a vertical length of 8 mm, and a height of 0.3 mm.

19. The electronic apparatus of claim 13, wherein the rectilinear ground part is grounded to the conductor of the circuit board by using one of an aluminum sheet and a copper sheet.

20. The electronic apparatus of claim 13, wherein the rectilinear ground part adjusts a radiation pattern and a radiation bandwidth of the antenna element by using the capacitance occurring between the antenna element and the rectilinear ground part.

21. The electronic apparatus of claim 20, wherein the capacitance increases with an increase in a length of the antenna element and decreases with an increase in the preset gap.

22. The electronic apparatus of claim 13, wherein the distance is 4 mm to thereby exhibit a maximum capacitor effect.

23. The electronic apparatus of claim 13, wherein the rectilinear ground part is connected to the ground of the cable exposed due to partial stripping of a coating of the cable to ground the cable.

24. The electronic apparatus of claim 13, wherein the dipole antenna module is disposed on a side of one of a display panel and a hinge of the electronic apparatus.

25. A dipole antenna module, comprising:

a first antenna element disposed on a circuit board and comprising a first dipole pattern and a second dipole pattern;

a second antenna element disposed on the circuit board, the second antenna element having an open point which a dipole pattern is not formed, and comprising a third dipole pattern symmetrical to the first dipole pattern and a fourth dipole pattern asymmetrical to the second dipole pattern;

a power feeder connected to the circuit board to transmit and receive antenna signals to and from the antenna element via a cable; and a rectilinear ground part disposed on the circuit board to be spaced apart from the second antenna element by a predetermined gap in a vertical direction and from the open point within the second antenna element in a horizontal direction to ground a ground of the cable, the predetermined gap is less than or equal to 1 mm, wherein the rectilinear ground part is capacitively coupled with and keeps the predetermined gap from the antenna element, wherein the rectilinear ground part and the second antenna element are separated and formed on a same side of the circuit board, and wherein the rectilinear ground part is formed on an adjacent region of the open point.

* * * * *